US008854023B2

(12) United States Patent
Ock

(10) Patent No.: US 8,854,023 B2
(45) Date of Patent: Oct. 7, 2014

(54) LOW DROPOUT LINEAR REGULATOR

(75) Inventor: Sungmin Ock, Plano, TX (US)

(73) Assignee: Texas Instruments Incorporated, Dallas, TX (US)

( * ) Notice: Subject to any disclaimer, the term of this patent is extended or adjusted under 35 U.S.C. 154(b) by 574 days.

(21) Appl. No.: 13/197,615

(22) Filed: Aug. 3, 2011

(65) Prior Publication Data

US 2013/0033244 A1 Feb. 7, 2013

(51) Int. Cl.
*G05F 1/00* (2006.01)
*G05F 1/565* (2006.01)
*G05F 1/56* (2006.01)

(52) U.S. Cl.
CPC ..... *G05F 1/56* (2013.01)
USPC ..... 323/280; 323/275

(58) Field of Classification Search
CPC ..... G05F 1/56
USPC ..... 323/273, 275, 279, 280, 281
See application file for complete search history.

(56) References Cited

U.S. PATENT DOCUMENTS 8,120,390 B1 * 2/2012 Mack ..... 327/108
2010/0103760 A1 * 4/2010 Mair et al. ..... 365/227

* cited by examiner

*Primary Examiner* — Matthew Nguyen
(74) *Attorney, Agent, or Firm* — Alan A. R. Cooper; Frederick J. Telecky, Jr.

(57) ABSTRACT

Various embodiments of the present invention provide apparatuses and methods for regulating an output voltage. For example, an apparatus is discussed that includes a low dropout regulator having a pass transistor and an amplifier and being operable to regulate the output voltage based on a feedback signal and a feedforward signal. The apparatus also includes an auxiliary low dropout regulator having an auxiliary pass transistor and an auxiliary amplifier. The auxiliary dropout regulator is operable to generate the feedforward signal and is substantially matched with the amplifier.

16 Claims, 6 Drawing Sheets

LOW DROPOUT LINEAR REGULATOR

BACKGROUND

A low dropout or LDO linear voltage regulator is an electronic circuit that is designed to provide a stable DC output voltage regardless of input voltage variations and load impedance. An LDO regulator is able to maintain output regulation even for a relatively small difference between the input voltage and the output voltage. For example, when regulating the voltage from a battery, an LDO regulator can maintain a steady output voltage for input voltages ranging from high battery voltages down to voltage levels just above the output voltage. A typical LDO regulator may use a field effect transistor (FET) as a current pass element, with the FET behaving as a resistor and dropping voltage across its terminals to maintain the desired output voltage. As the load current or input voltage changes, the gate to source voltage of the FET is adjusted by a control circuit to keep the output in regulation. The FET operates in the linear region as long as it has a minimum resistance, but if the control circuit causes the FET to operate below this minimum resistance, the FET enters the saturation region and the LDO is in dropout. Generally, the dropout voltage should be as low as possible for an LDO regulator.

Another important characteristic of an LDO regulator is its supply rejection, the ability to reject noise from the power supply. The supply rejection of a conventional LDO regulator depends on the loop gain of the regulator. Because the loop stability limits the available loop gain, it can be difficult to achieve high supply rejection at high frequency due to the limited loop gain. One technique to improve supply rejection is to include an RC filter made up of a resistor-capacitor network to filter supply noise at the input of the regulator. However, using an RC filter to increase supply rejection also results in a high dropout voltage. Another technique to improve supply rejection is to use cascaded NMOS and PMOS pass elements, with the gate voltage for the NMOS pass element being raised higher than the supply voltage by a charge pump. However, this technique increases circuit complexity and leads to high power consumption.

Yet another technique to improve supply rejection in an LDO regulator is to use a feedforward path to cancel ripple at the input from the power supply. Typically, in an LDO regulator a DC reference voltage is used to set the output voltage. In an LDO regulator with feedforward, a feedforward path is used in conjunction with the DC reference voltage to cancel input ripple. As illustrated in FIG. 1, the pass element 10 is controlled by the combination of a main error amplifier path 12 and a feedforward path 14. The main error amplifier path 12 compares the voltage at the output 16 with the DC reference voltage 20 to generate a feedback signal 22. The feedforward path 14 generates a feedforward signal 24 using additional amplifiers (e.g., 26) with resistors (e.g., 30 and 32) and capacitors (e.g., 34). The feedforward signal 24 contains a representation of the ripple noise from the power supply 36 which is combined in amplifier 40 with the feedback signal 22 to achieve high supply rejection.

However, the feedforward signal 24 generated using amplifiers (e.g., 26) with resistors (e.g., 30 and 32) and capacitors (e.g., 34) is susceptible to process-voltage-temperature (PVT) variations because of the large variations of RC values in the feedforward path 14. In addition, when the gain of the main amplifier 40 is modified, the feedforward path 14 should be adjusted accordingly, adding complexity to the LDO regulator 42.

SUMMARY

Various embodiments of the present invention provide apparatuses and methods for regulating an output voltage. For example, an apparatus is discussed that includes a low dropout regulator having a pass transistor and an amplifier and being operable to regulate the output voltage based on a feedback signal and a feedforward signal. The apparatus also includes an auxiliary low dropout regulator having an auxiliary pass transistor and an auxiliary amplifier. The auxiliary dropout regulator is operable to generate the feedforward signal using an amplifier that is substantially matched with the amplifier in the main low dropout regulator, although in some cases they are sized differently to reduce power usage in the auxiliary low dropout regulator. In various instances, the apparatus includes a DC reference voltage input connected to the amplifier and to the auxiliary amplifier. The low dropout regulator is operable to regulate the output voltage at a level established by the DC reference voltage input. In some cases, the feedforward signal is inverted in an inverter with unity gain. In other cases, the apparatus includes an adder connected to the feedback signal and the feedforward signal, with the adder output connected to the amplifier. In yet other cases, the amplifier is a multi-input amplifier that is operable to combine the feedback signal and the feedforward signal. In some instances, the multi-input amplifier in the low dropout regulator has two inverting inputs connected to the DC reference voltage and two non-inverting inputs connected to the feedback signal and the feedforward signal. In some instances, the multi-input auxiliary amplifier has two inverting inputs and one non-inverting input connected to the DC reference voltage and one non-inverting input connected to the feedforward signal.

In some instances of the aforementioned embodiments, the multi-input amplifier and the auxiliary multi-input amplifier are differential single stage amplifiers with operational amplifier active loads and with multiple source follower inputs operable to combine multiple non-inverting inputs and multiple inverting inputs. In other instances, the multi-input amplifier and the auxiliary multi-input amplifier are differential single stage amplifiers with operational amplifier active loads and with multiple parallel differential input stages.

Various instances of the aforementioned embodiments include voltage dividers at the outputs of the low dropout regulator and the auxiliary low dropout regulator to generate the feedback signal and feedforward signal. In some instances the voltage dividers have the same divider ratio.

In some instances of the aforementioned embodiments, an output capacitor and an output current supply are connected the outputs of the low dropout regulator and the auxiliary low dropout regulator, with output current supply in the auxiliary low dropout regulator producing a lower current level than the output current supply in the low dropout regulator.

Other embodiments of the present invention provide methods for regulating an output voltage. The methods include controlling the voltage drop across a pass element between a power supply and a voltage output using a low dropout regulator, generating a feedforward signal using an auxiliary low dropout regulator, and combining a feedback signal in the low dropout regulator with the feedforward signal. The first amplifier in the auxiliary low dropout regulator is matched to a second amplifier in the low dropout regulator. In some instances, combining the feedback signal in the low dropout regulator with the feedforward signal is operable to cancel supply noise from the power supply in the voltage output. Some embodiments of the methods include inverting the feedforward signal. In some instances, the current through the low dropout regulator is greater than a second current through the auxiliary low dropout regulator.

This summary provides only a general outline of some particular embodiments. Many other objects, features, advantages and other embodiments will become more fully apparent from the following detailed description, the appended claims and the accompanying drawings.

BRIEF DESCRIPTION OF THE DRAWINGS

A further understanding of the various embodiments may be realized by reference to the figures which are described in remaining portions of the specification. In the figures, like reference numerals may be used throughout several drawings to refer to similar components.

DETAILED DESCRIPTION

Various embodiments of the present invention provide apparatuses and methods for regulating an output voltage, including low dropout (LDO) linear regulators with feedforward paths for high supply rejection. The LDO regulators generate the feedforward signal using an additional auxiliary LDO regulator that has the same amplifier used in the main LDO regulator. The pass transistor in the auxiliary LDO regulator may be smaller than the pass transistor in the main LDO regulator to minimize power usage, while providing high supply rejection by using matching amplifiers in the main and auxiliary regulators. Additionally, adjustment of amplifier gain is simplified by using the same amplifier in the main and auxiliary regulators.

Figure 2:
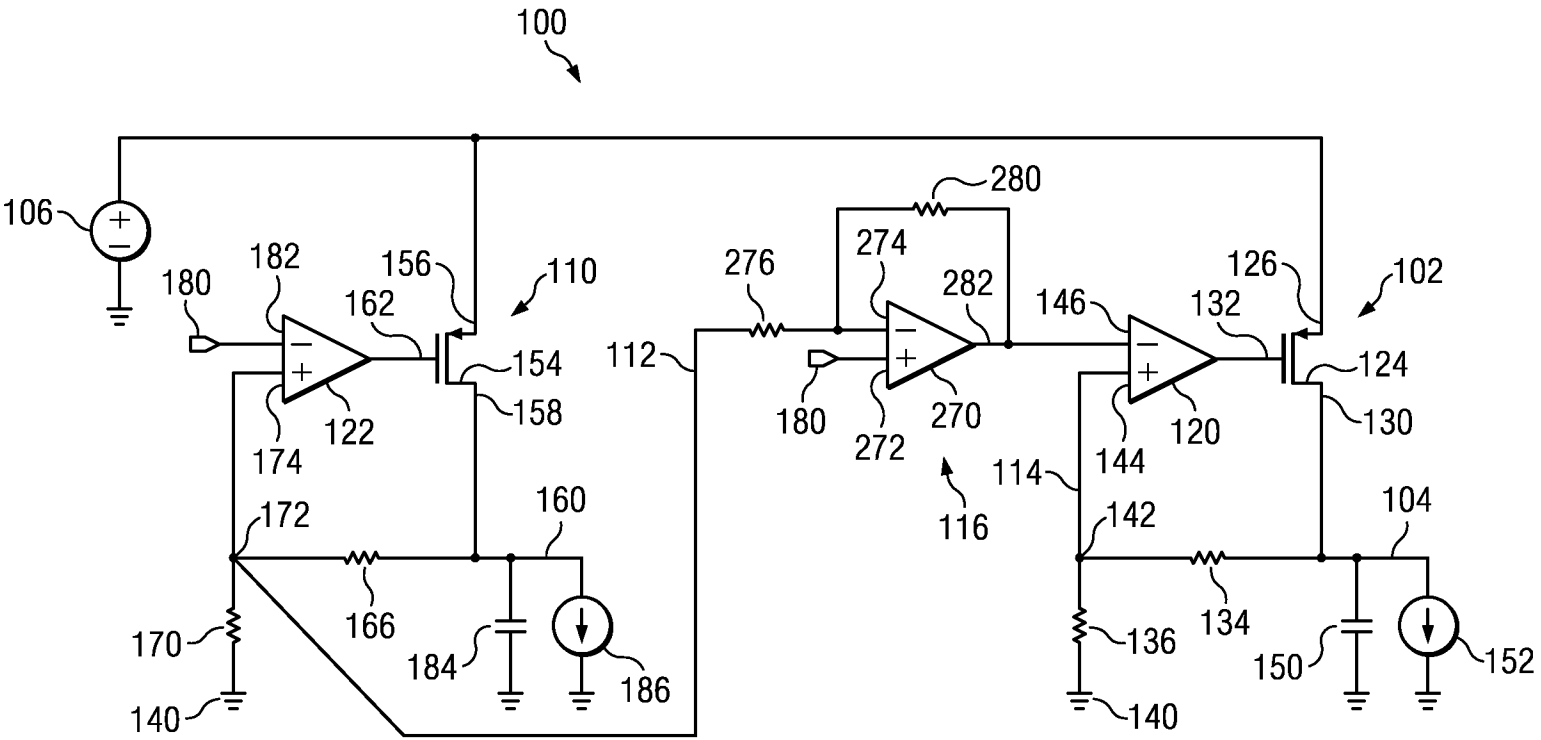
FIG. 2 depicts an LDO regulator with feedforward path using an auxiliary regulator using an amplifier copied from the main regulator and with an inverter in the feedforward path in accordance with some embodiments.

Turning now to FIG. 2, an example of an LDO linear regulator 100 with high supply rejection includes a main LDO regulator 102 to regulate the voltage at an output 104 while rejecting noise from a power supply 106. An auxiliary LDO regulator 110 generates a feedforward signal 112 which is inverted before combining with the feedback signal 114 of the main LDO regulator 102, for example by inverter 116. The circuit operates in analog mode, so the inverter 116 changes the polarity of AC signals without changing the DC voltage. The supply noise is thus amplified the same way in the auxiliary LDO regulator 110 as in the main LDO regulator 102, and combined in inverted fashion in the main LDO regulator 102 to cancel noise from the power supply 106 in the output 104. The amplification of noise in the auxiliary LDO regulator 110 is matched to that in the main LDO regulator 102 by using the same amplifiers 120 and 122 and associated components in the main LDO regulator 102 and auxiliary LDO regulator 110.

The main LDO regulator 102 and auxiliary LDO regulator 110, while matched, are not limited to the examples presented herein, and any LDO regulator architecture currently known or that may be developed in the future may be selected. For purposes of illustration, in the example embodiment of FIG. 2, the main LDO regulator 102 uses a P-channel metal-oxide-semiconductor field-effect transistor (P-channel MOSFET) or PMOS transistor 124 as a pass element, with the source 126 connected to power supply 106, the drain 130 connected to output 104, and the gate 132 connected to the output of amplifier 120. The feedback signal 114 is a divided form of output 104, generated by a voltage divider consisting of resistor 134 and resistor 136 connected in series between output 104 and ground 140, with feedback signal 114 taken from the node 142 between resistors 134 and 136. The feedback signal 114 is connected to the non-inverting input 144, and the inverted feedforward signal 112 is connected to the inverting input 146 of amplifier 120. An output capacitor 150 and output current supply 152 are connected between the output 104 and ground 140 in parallel with any load (not shown).

When considered in isolation, the behavior of the main LDO regulator 102 is described by Equations 1 and 2 below:

$$V_{out}(s) = \left( \frac{(R_{f1} + R_{f2}) // \frac{1}{sC_{out}}}{R_{out} + (R_{f1} + R_{f2}) // \frac{1}{sC_{out}}} \right) \frac{(1 + g_m R_{out})}{1 + A_{reg}(s)} V_{dd}(s) \quad \text{Equation 1}$$

where $$A_{reg}(s) = g_m \left[ R_{out} // (R_{f1} + R_{f2}) // \frac{1}{sC_{out}} \right] \left( \frac{R_{f2}}{R_{f1} + R_{f2}} \right) A(s) \quad \text{Equation 2}$$

where:

$R_{f1}$: resistance of feedback resistor 134

$R_{f2}$: resistance of feedback resistor 136

$C_{out}$: output capacitor 150

$g_m$: transconductance of transistor 124

$R_{out}$: resistance of transistor 124

A(s): transfer function of amplifier 120

$V_{dd}$(s): voltage from power supply 106

When the voltage of the feedback signal 114 rises above the voltage of the inverted feedforward signal 112, the output of the amplifier 120 rises and the voltage drop across the transistor 124 increases, lowering the voltage at the output 104. When the voltage of the feedback signal 114 falls below the voltage of the inverted feedforward signal 112, the output of the amplifier 120 falls and the voltage drop across the transistor 124 decreases, raising the voltage at the output 104. Again, any type of LDO regulator may be selected, with matching auxiliary LDO regulator 110, to provide high supply rejection. For example, the pass element may comprise in various types of LDO regulators a common source PMOS transistor, cascaded NMOS and PMOS, NMOS follower, NPN Darlington, NPN follower, common emitter lateral PNP, etc.

The auxiliary LDO regulator 110 is substantially matched with the main LDO regulator 102, although the output current may be limited to reduce power usage. The auxiliary LDO regulator 110 thus includes a PMOS 154 as pass element between power supply 106 and auxiliary output 160, with the source 156 connected to power supply 106, the drain 158 connected to auxiliary output 160, and the gate 162 connected to the output of amplifier 122. The feedforward signal 112 is also used as a feedback signal in the auxiliary LDO regulator 110 and is a divided form of auxiliary output 160. Feedforward signal 112 is generated from the auxiliary output 160 by a voltage divider consisting of resistor 166 and resistor 170 connected in series between auxiliary output 160 and ground 140, with feedforward signal 112 taken from the node 172 between resistors 166 and 170. The feedforward signal 112 is connected to the non-inverting input 174. A reference voltage $V_{ref}$ 180 is connected to the inverting input 182 of amplifier 122 and is used to set the DC voltage level at auxiliary output 160 (and thus at output 104 of main LDO regulator 102). An auxiliary output capacitor 184 and auxiliary output current supply 186 are connected between the auxiliary output 160 and ground 140. While the auxiliary output 160 will substantially track the desired voltage of output 104, it does not have the high supply rejection of output 104 that is provided by the inverted feedforward signal 112.

Figure 1:
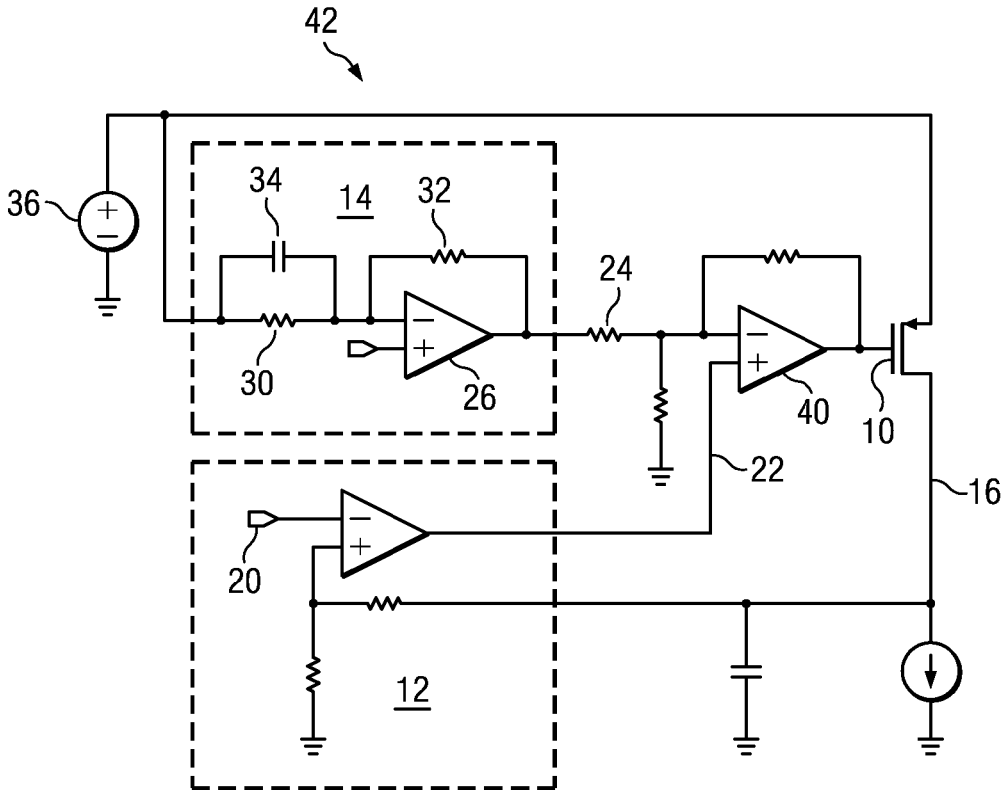
FIG. 1 (PRIOR ART)
FIG. 1 depicts a prior art LDO regulator with a feedforward path including an amplifier with RC network.
Figure 3:
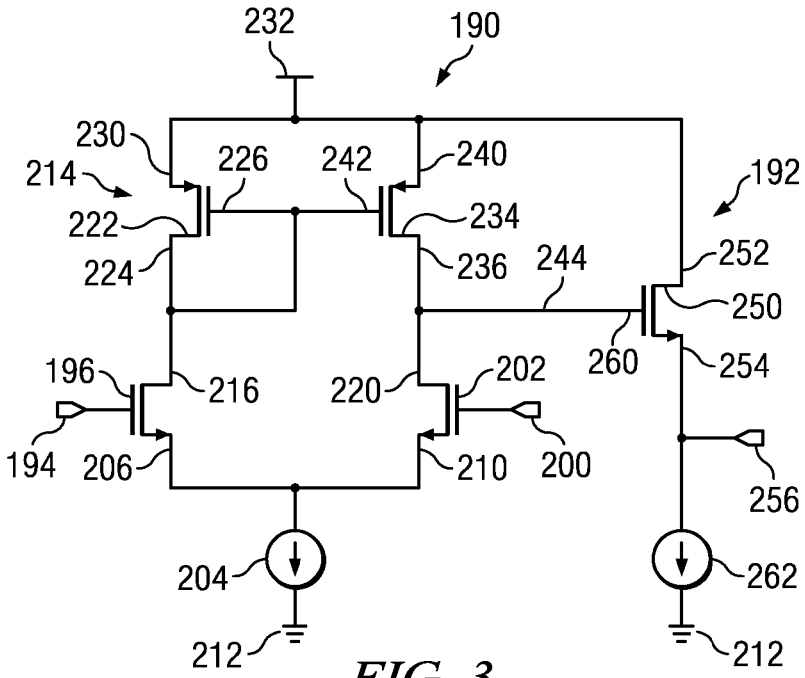
FIG. 3 depicts a single stage amplifier with source follower buffer that may be used as the amplifier in the auxiliary regulator and the main regulator of an LDO regulator in accordance with some embodiments.

Referring now to FIG. 3, a single stage amplifier 190 with source follower buffer 192 is illustrated that may be suitable for use as the amplifier 120 and amplifier 122 of some embodiments of an LDO regulator with high supply rejection. However, the amplifier 120 and amplifier 122 is not limited to the example amplifier architecture illustrated in FIG. 3. The non-inverting input 194 controls a first input NMOS transistor 196. The inverting input 200 controls a second NMOS transistor 202 in parallel with the first transistor 196. A current supply 204 is connected between the sources 206 and 210 of transistors 196 and 202 and ground 212, and supplies a constant tail current that is divided between transistors 196 and 202. A current mirror 214 is connected to the drains 216 and 220 of transistors 196 and 202 and provides an active load to amplifier 190. The current mirror 214 includes a diode-connected PMOS transistor 222 having the drain 224 and gate 226 connected to the drain 216 of transistor 196, and having the source 230 connected to power supply 232. The current mirror 214 also includes a driven PMOS transistor 234 having drain 236 connected to drain 220 of transistor 202, source 240 connected to power supply 232, and gate 242 connected to the drain 224 and gate 226 of transistor 222.

During operation, the current mirror 214 forces the current through transistors 222 and 234 to be equal. As the voltage at non-inverting input 194 exceeds that at inverting input 200, more current from the current supply 204 is shifted through transistor 196 than transistor 202, and the current mirror 214 forces the output 244 of amplifier 190 to sink additional current, increasing the voltage at the output 244. Conversely, when the voltage at inverting input 200 exceeds that at non-inverting input 194, current through transistor 202 is increased and current through transistor 196 is decreased. The current mirror 214 drives a similar current decrease through transistor 234, forcing output 244 to source the additional current, decreasing the voltage at output 244. The source follower buffer 192 includes an NMOS transistor 250 having the drain 252 connected to power supply 232 and the source 254 connected to output 256. The gate 260 of transistor 250 is connected to the output 244 of the single stage amplifier 190. A current source 262 is connected between output 256 and ground 212. The amplifier 190 and source follower buffer 192 convert the differential input to a single ended output 256 with a voltage proportional to the difference between non-inverting input 194 and inverting input 200.

Although the same amplifier 122 is used in the auxiliary LDO regulator 110 as the amplifier 120 of the main LDO regulator 102, the current through PMOS 154 may be minimized to reduce power usage. This may be accomplished, for example, by selecting a PMOS 154 with smaller area than that of transistor 124 in the main LDO regulator 102 and adapting auxiliary output current supply 186 to a lower current level than that of output current supply 152 in the main LDO regulator 102. The auxiliary output 160 can thus be set at the desired voltage level while using lower current because no external load will be driven by auxiliary output 160.

In the embodiment of FIG. 2, the voltage divider resistors 166 and 170 in the auxiliary LDO regulator 110 are adapted to divide the auxiliary output 160 by the same ratio as the voltage divider resistors 134 and 136 divide the output 104 in the main LDO regulator 102. This causes the inverted ripple in the inverted feedforward signal 112 to cancel the ripple from the power supply 106 at the output 104, given an inverter 116 with unity gain. In other embodiments, the feedforward signal 112 may be divided at a different ratio with the gain of inverter 116 adjusted accordingly and with the Vref 180 adjusted and a DC bias applied to feedforward signal 112 as needed.

Typically, the reference voltage $V_{ref}$ is a DC reference value for an LDO regulator. However, as is shown in Equations 3, 4 and 5 below, when using a feedforward signal rather than Vref, an extra term is added to the end of Equation 1, producing Equation 3 below, and when $V_{ref}(s)$ is set to $-1/A(s)\times V_{dd}(s)$, supply noise is cancelled. Equations 3, 4 and 5 describe the behavior of the main LDO regulator 102, with $V_{ref}(s)$ being the signal at the inverting input 146 of amplifier 120:

$$V_{out}(s) = \left(\frac{(R_{f1}+R_{f2}) // \frac{1}{sC_{out}}}{R_{out}+(R_{f1}+R_{f2}) // \frac{1}{sC_{out}}}\right)\left[\frac{(1+g_m R_{out})}{1+A_{reg}(s)}V_{dd}(s)+\frac{g_m R_{out}A(s)}{1+A_{reg}(s)}V_{ref}(s)\right] \quad \text{Equation 3}$$

$$A_{reg}(s) = g_m\left[R_{out} // (R_{f1}+R_{f2}) // \frac{1}{sC_{out}}\right]\left(\frac{R_{f2}}{R_{f1}+R_{f2}}\right)A(s) \quad \text{Equation 4}$$

when $$V_{ref}(s) \text{ is } -\frac{1}{A(s)}\left(1+\frac{1}{g_m R_{out}}\right)V_{dd}(s) \approx -\frac{1}{A(s)}V_{dd}(s), \quad V_{out}(s)=0 \quad \text{Equation 5}$$

where:

$R_{f1}$: resistance of feedback resistor 134

$R_{f2}$: resistance of feedback resistor 136

$C_{out}$: output capacitor 150

$g_m$: transconductance of transistor 124

$R_{out}$: resistance of transistor 124

A(s): transfer function of amplifier 120

$V_{dd}(s)$: voltage from power supply 106

$V_{ref}(s)$: reference signal at inverting input 146 of amplifier 120

$V_{out}(s)$: supply noise

Given that auxiliary LDO regulator 110 has the same topology as main LDO regulator 102 with matched amplifiers 122 and 120, similar equations describe the behavior of the auxiliary LDO regulator 110 and can be used to derive the desired feedforward signal:

$$V_{out2}(s) = \left(\frac{(R_{feed1}+R_{feed2}) // \frac{1}{sC_{out2}}}{R_{out2}+(R_{feed1}+R_{feed2}) // \frac{1}{sC_{out2}}}\right)\frac{(1+g_{m2}R_{out2})}{1+A_{reg2}(s)}V_{dd}(s) \quad \text{Equation 6}$$

where $$A_{reg2}(s) = g_{m2}\left[R_{out2} // (R_{feed1}+R_{feed2}) // \frac{1}{sC_{out2}}\right]\left(\frac{R_{feed2}}{R_{feed1}+R_{feed2}}\right)A(s) \quad \text{Equation 7}$$

When $g_{m2}R_{out2}>>1$, $$V_{out2}(s) = \frac{g_{m2}}{1+A_{reg2}(s)}\left[R_{out2} // (R_{feed1}+R_{feed2}) // \frac{1}{sC_{out2}}\right]V_{dd}(s) \quad \text{Equation 8}$$

Therefore, $$V_{feed}(s) = \frac{R_{feed2}}{R_{feed1}+R_{feed2}}V_{out2}(s) = \frac{g_{m2}\left(\frac{R_{feed2}}{R_{feed1}+R_{feed2}}\right)\left[R_{out2} // (R_{feed1}+R_{feed2}) // \frac{1}{sC_{out2}}\right]}{1+g_{m2}\left(\frac{R_{feed2}}{R_{feed1}+R_{feed2}}\right)\left[R_{out2} // (R_{feed1}+R_{feed2}) // \frac{1}{sC_{out2}}\right]A(s)}V_{dd}(s) \approx \frac{1}{A(s)}V_{dd}(s) \quad \text{Equation 9}$$

where:

A(s): transfer function of amplifier 122

$V_{dd}$(s): voltage from power supply 106

$R_{feed1}$: resistance of auxiliary feedback resistor 166

$R_{feed2}$: resistance of auxiliary feedback resistor 170

$C_{out2}$: auxiliary output capacitor 184

$g_{m2}$: transconductance of transistor 154

$R_{out2}$: resistance of transistor 154

$V_{out2}$(s): supply noise at auxiliary output 160

$V_{feed}$(s): feedforward signal 112 at node 172

Thus, as shown in Equation 9, the auxiliary LDO regulator 110 can be used to generate a feedforward signal 112 that, when inverted, provides the reference voltage calculated in Equation 5 to cancel supply noise in the output 104.

The feedforward signal 112 may be inverted in any suitable manner. For example, as illustrated in FIG. 2, the feedforward signal 112 may be inverted by a inverter 116 having unity gain. In some embodiments, the inverter 116 includes an amplifier 270 connected to reference voltage Vref 180 at the non-inverting input 272, and with the feedforward signal 112 connected to the inverting input 274 through resistor 276. Feedback resistor 280 is connected between the inverting input 274 and the output 282 of amplifier 270. The inverter 116 is configured with unity gain in some embodiments by using the same value resistor for resistors 276 and 280. The inverted feedforward signal 112 appears at the output 282 of amplifier 270 and is connected to the inverting input 146 of amplifier 120 in the main LDO regulator 102.

Figure 4:
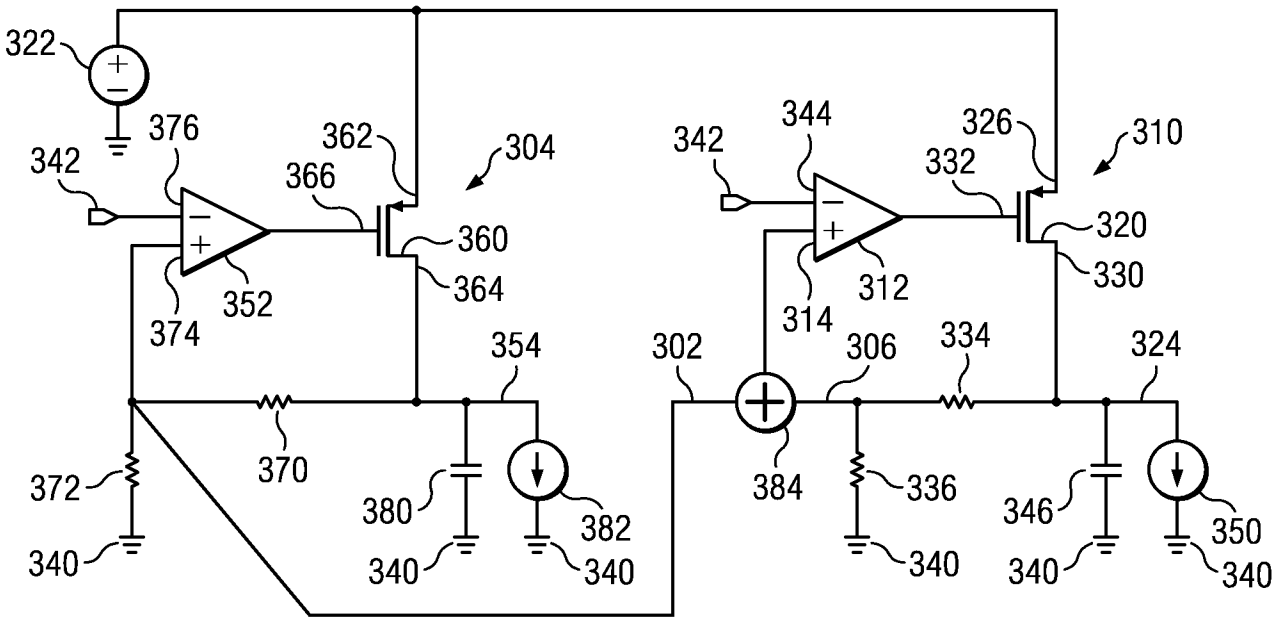
FIG. 4 depicts an LDO regulator with feedforward path that combines feedback and feedforward signals without an inverter in accordance with some embodiments.

Referring now to FIG. 4, an embodiment of an LDO regulator is illustrated which combines the feedforward signal 302 from an auxiliary LDO regulator 304 with the feedback signal 306 in a main LDO regulator 310 at the same port of the amplifier 312 in the main LDO regulator 310, in this case the non-inverting input 314. By combining the feedforward signal 302 with the feedback signal 306, supply noise is cancelled without the need for an inverter.

The main LDO regulator 310 includes a PMOS transistor 320 as a pass element between power supply 322 and the output 324. The source 326 of transistor 320 is connected to power supply 322, the drain 330 is connected to output 324, and the gate 332 is connected to the output of amplifier 312. The feedback signal 306 is a divided form of output 324, generated by a voltage divider consisting of resistor 334 and resistor 336 connected in series between output 324 and ground 340. A reference voltage signal $V_{ref}$ 342 is connected to the inverting input 344 of amplifier 312 to set the desired voltage level at output 324. An output capacitor 346 and output current supply 350 are connected between the output 324 and ground 340 in parallel with any load (not shown).

As with other embodiments discussed above, the amplifier 352 in the auxiliary LDO regulator 304 is matched to the amplifier 312 in the main LDO regulator 310, although the current at the auxiliary output 354 may be lower to minimize power usage. The auxiliary LDO regulator 304 includes a PMOS transistor 360 as pass element connected between power supply 322 and auxiliary output 354. The source 362 of transistor 360 is connected to power supply 322, the drain 364 is connected to auxiliary output 354, and the gate 366 is connected to the output of amplifier 352. The feedforward signal 302 is also used as a feedback signal in the auxiliary LDO regulator 304 and is a divided form of auxiliary output 354. Feedforward signal 302 is generated from the auxiliary output 354 by a voltage divider consisting of resistor 370 and resistor 372 connected in series between auxiliary output 354 and ground 340. The feedforward signal 302 is connected to the non-inverting input 374 of amplifier 352. The same reference voltage $V_{ref}$ 342 used for amplifier 312 in the main LDO regulator 310 is connected to the inverting input 376 of amplifier 352 and is used to set the DC voltage level at auxiliary output 354. An auxiliary output capacitor 380 and auxiliary output current supply 382 are connected between the auxiliary output 354 and ground 340. While the auxiliary output 354 will substantially track the desired voltage of output 324, it does not have the high supply rejection of output 324 that is provided by the feedforward signal 302.

The feedforward signal 302 may be combined with the feedback signal 306 in any suitable manner, such as in an independent circuit element such as an adder 384, amplifier or any other suitable device to combine the AC component of feedforward signal 302 with the feedback signal 306. In other embodiments, the feedforward signal 302 may be combined with the feedback signal 306 directly in the amplifier of the LDO regulator by using a multi-input amplifier as illustrated in FIG. 5.

Figure 5:
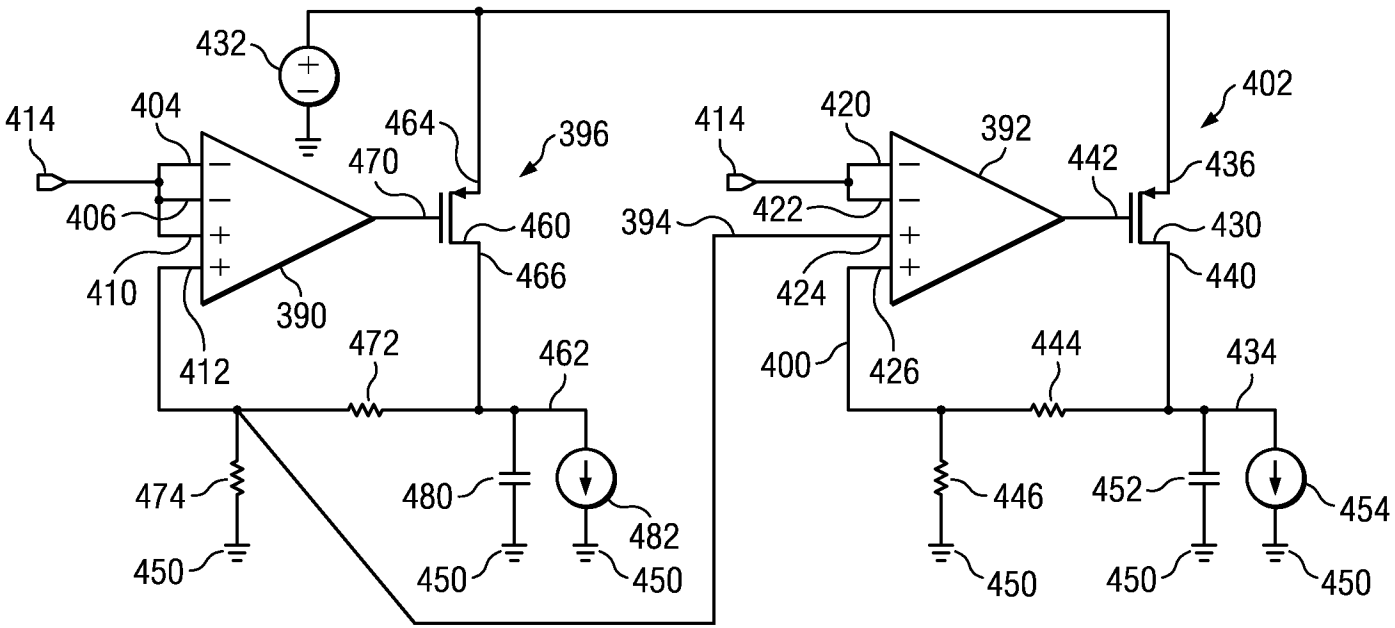
FIG. 5 depicts another LDO regulator with multi-input auxiliary and main regulators to combine feedback and feedforward signals without an inverter in accordance with some embodiments.

Referring now to FIG. 5, an embodiment of an LDO regulator with high supply rejection is illustrated which uses multi-input amplifiers 390 and 392 to invert and combine the feedforward signal 394 from auxiliary LDO regulator 396 with the feedback signal 400 in the main LDO regulator 402. Each amplifier 390 and 392 includes multiple inputs enabling the feedforward signal 394 and feedback signal 400 to be combined without an inverter. For example, amplifier 390 in the auxiliary LDO regulator 396 includes two inverting inputs 404 and 406 and two non-inverting inputs 410 and 412. The voltage reference signal $V_{ref}$ 414 is connected to both inverting inputs 404 and 406 and one non-inverting input 410, and the feedforward signal 394 is connected to the other non-inverting input 412. Amplifier 392 in the main LDO regulator 402 also includes two inverting inputs 420 and 422 and two non-inverting inputs 424 and 426. The voltage reference signal $V_{ref}$ 414 is connected to both inverting inputs 420 and 422, the feedforward signal 394 is connected to one non-inverting input 424 and the feedback signal 400 is connected to the other non-inverting input 426. With $V_{ref}$ 414 connected to a non-inverting input 410 of the amplifier 390 in the auxiliary LDO regulator 396 and to only inverting inputs 420 and 422 of the amplifier 392 in the main LDO regulator 402, the feedforward signal 394 is effectively inverted as it is combined with the feedback signal 400 in the amplifier 392. Notably, the number of inputs in each multi-input amplifier 390 and 392 is not limited to the examples provided in FIG. 5.

The multi-input amplifiers 390 and 392 may each be equivalent to a pair of amplifiers each with an inverting input and a non-inverting input, with the outputs from the pair of amplifiers combined. For example, inputs 404 and 410 may be supplied to a first two-input amplifier and inputs 406 and 412 supplied to a second two-input amplifier, with the outputs combined and connected to the gate 470 of transistor 460. Because inputs 404 and 410 are shorted, the output of the first amplifier would make no contribution to the total output. However, they are included to match the amplifier 390 to the amplifier 392.

The main LDO regulator 402 includes a PMOS transistor 430 as a pass element between power supply 432 and the output 434. The source 436 of transistor 430 is connected to power supply 432, the drain 440 is connected to output 434, and the gate 442 is connected to the output of amplifier 392. The feedback signal 400 is a divided form of output 434, generated by a voltage divider consisting of resistor 444 and resistor 446 connected in series between output 434 and ground 450. An output capacitor 452 and output current supply 454 are connected between the output 434 and ground 450 in parallel with any load (not shown).

The auxiliary LDO regulator 396 includes a PMOS transistor 460 as pass element connected between power supply 432 and auxiliary output 462. The source 464 of transistor 460 is connected to power supply 432, the drain 466 is connected to auxiliary output 462, and the gate 470 is connected to the output of amplifier 390. The feedforward signal 394 is also used as a feedback signal in the auxiliary LDO regulator 396 and is a divided form of auxiliary output 462. Feedforward signal 394 is generated from the auxiliary output 462 by a voltage divider consisting of resistor 472 and resistor 474 connected in series between auxiliary output 462 and ground 450. The feedforward signal 394 is connected to one of the non-inverting inputs 412 of amplifier 390. An auxiliary output capacitor 480 and auxiliary output current supply 482 are connected between the auxiliary output 462 and ground 450. As with other embodiments discussed above, the amplifier 390 in the auxiliary LDO regulator 396 is matched to the amplifier 392 in the main LDO regulator 402, although the current at the auxiliary output 462 may be lower to minimize power usage by using a smaller transistor 460 and reducing current through auxiliary output current supply 482.

Figure 6:
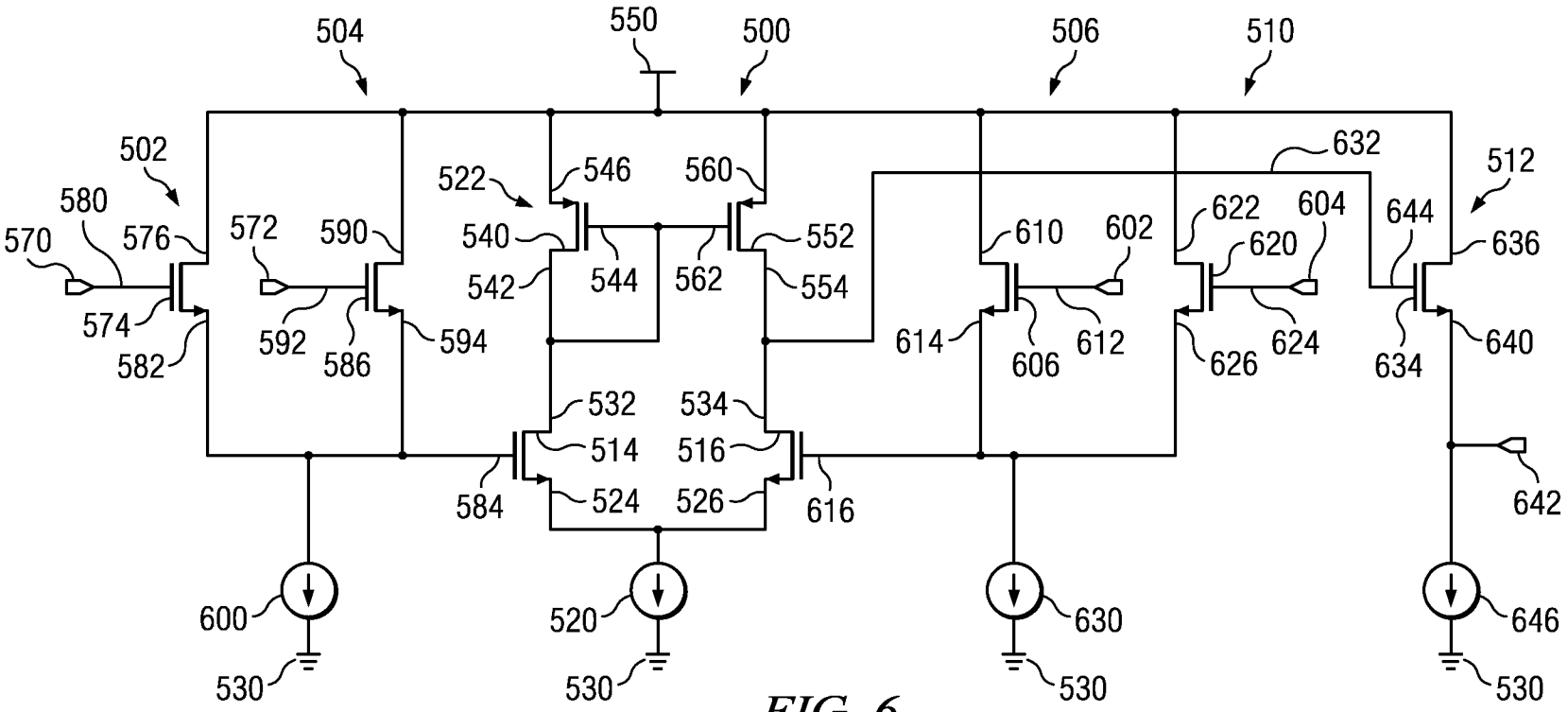
FIG. 6 depicts a multi-input amplifier with source follower buffer that may be used as the amplifier in the auxiliary regulator and the main regulator of an LDO regulator in accordance with some embodiments.

Referring now to FIG. 6, a multi-input amplifier suitable for use in various embodiments of the auxiliary LDO regulator 396 and main LDO regulator 402 may include a single stage amplifier 500 with source follower input buffers 502, 504, 506 and 510 and with source follower output buffer 512. The single stage amplifier 500 includes differential input NMOS transistors 514 and 516, with bias current supplied by tail current supply 520 and with current mirror 522 providing an active load. The current supply 520 is connected between the sources 524 and 526 of transistors 514 and 516 and ground 530, supplying a constant tail current that is divided between transistors 514 and 516. Current mirror 522 is connected to the drains 532 and 534 of transistors 514 and 516 to provide an active load to amplifier 500. The current mirror 522 includes a diode-connected PMOS transistor 540 having the drain 542 and gate 544 connected to the drain 532 of transistor 514, and having the source 546 connected to power supply 550. The current mirror 522 also includes a driven PMOS transistor 552 having drain 554 connected to drain 534 of transistor 516, source 560 connected to power supply 550, and gate 562 connected to the drain 542 and gate 544 of transistor 540.

The non-inverting input transistor 514 is controlled by two non-inverting inputs 570 and 572 via source follower input buffers 502 and 504, respectively. Input buffer 502 includes an NMOS transistor 574 with drain 576 connected to power supply 550, gate 580 connected to non-inverting input 570, and source 582 connected to gate 584 of transistor 514. Input buffer 504 includes an NMOS transistor 586 with drain 590 connected to power supply 550, gate 592 connected to non-inverting input 572, and source 594 connected to gate 584 of transistor 514. A bias current is provided for source follower input buffers 502 and 504 by current supply 600, which is connected between sources 582 and 594 of transistors 574 and 586 and ground 530.

The inverting input transistor 516 is controlled by two inverting inputs 602 and 604 via source follower input buffers 506 and 510, respectively. Input buffer 602 includes an NMOS transistor 606 with drain 610 connected to power supply 550, gate 612 connected to inverting input 602, and source 614 connected to gate 616 of transistor 516. Input buffer 510 includes an NMOS transistor 620 with drain 622 connected to power supply 550, gate 624 connected to inverting input 604, and source 626 connected to gate 616 of transistor 516. A bias current is provided for source follower input buffers 506 and 510 by current supply 630, which is connected between sources 614 and 626 of transistors 606 and 620 and ground 530.

During operation, the current mirror 522 forces the current through transistors 540 and 552 to be equal. As the voltage at gate 584 of transistor 514, driven by the combination of non-inverting inputs 570 and 572, exceeds that at gate 616 of transistor 516, driven by the combination of inverting inputs 602 and 604, more current from the current supply 520 is shifted through transistor 514 than transistor 516. Current mirror 522 forces the output 632 of amplifier 500 to sink additional current, increasing the voltage at the output 632. Conversely, when the voltage at gate 616 of transistor 516, driven by the combination of inverting inputs 602 and 604, exceeds that at gate 584 of transistor 514, driven by the combination of non-inverting inputs 570 and 572, current through transistor 516 is increased and current through transistor 514 is decreased. The current mirror 522 drives a similar current decrease through transistor 552, forcing output 632 to source the additional current, decreasing the voltage at output 632. The output source follower buffer 512 includes an NMOS transistor 634 having the drain 636 connected to power supply 550 and the source 640 connected to output 642. The gate 644 of transistor 634 is connected to the output 632 of the single stage amplifier 500. A current source 646 is connected between output 642 and ground 530. The amplifier 500, input buffers 502, 504, 506 and 510 and output buffer 512 convert the combined differential inputs to a single ended output 642 with a voltage proportional to the difference between the combination of non-inverting inputs 570 and 572 and the combination of inverting inputs 602 and 604.

Figure 7:
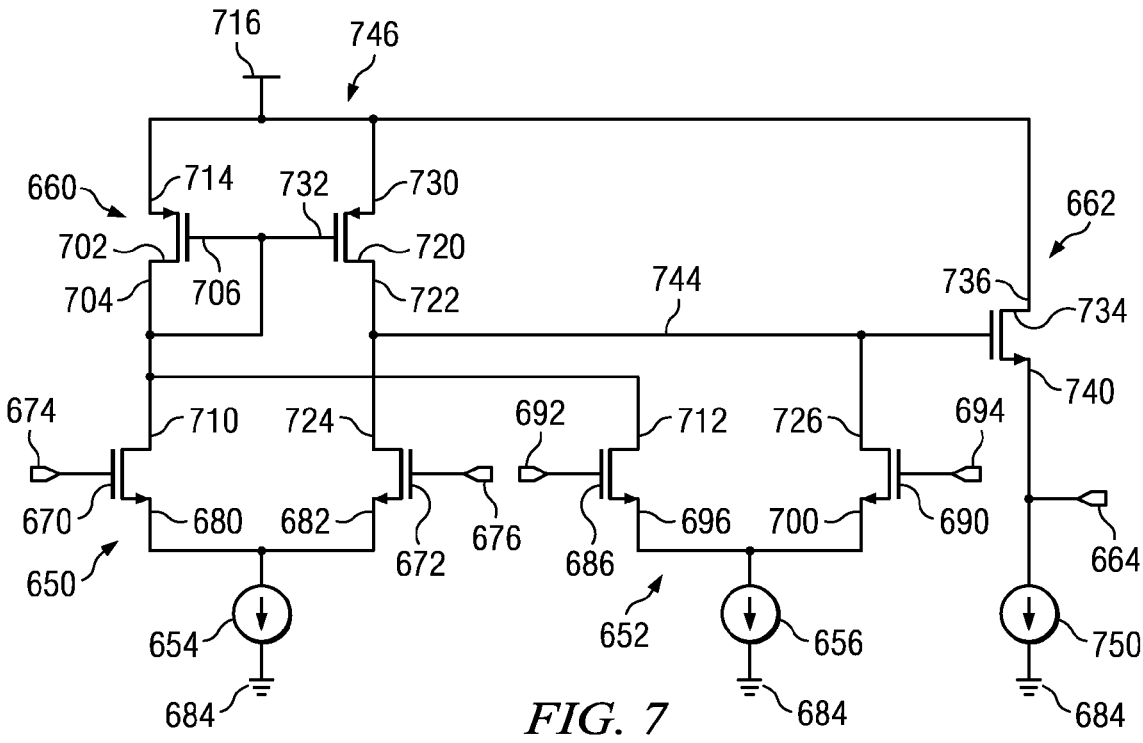
FIG. 7 depicts a multi-input amplifier with parallel input stages that may be used as the amplifier in the auxiliary regulator and the main regulator of an LDO regulator in accordance with some embodiments.

In some embodiments, amplifiers with source follower input buffers may be disadvantageous due to DC conditions. Referring now to FIG. 7, another multi-input amplifier suitable for use in various embodiments of the auxiliary LDO regulator 396 and main LDO regulator 402 includes two parallel input stages 650 and 652, each with their own tail current supply 654 and 656 but sharing a current minor 660 as active load. A source follower buffer 662 is used to drive the output 664. The first input stage 650 includes differential input NMOS transistors 670 and 672, controlled by the first non-inverting input 674 and the first inverting input 676, respectively. The current supply 654 is connected between the sources 680 and 682 of transistors 670 and 672 and ground 684, supplying a constant tail current that is divided between transistors 670 and 672. The second input stage 652 includes differential input NMOS transistors 686 and 690, controlled by the second non-inverting input 692 and the second inverting input 694, respectively. The current supply 656 is connected between the sources 696 and 700 of transistors 686 and 690 and ground 684, supplying a constant tail current that is divided between transistors 686 and 690.

Current mirror 660 is connected to both parallel input stages 650 and 652 to provide an active load. The current minor 660 includes a diode-connected PMOS transistor 702 having the drain 704 and gate 706 connected to the drains 710 and 712 of transistors 670 and 686, and having the source 714 connected to power supply 716. The current minor 660 also includes a driven PMOS transistor 720 having drain 722 connected to drains 724 and 726 of transistors 672 and 690, source 730 connected to power supply 716, and gate 732 connected to the drain 704 and gate 706 of transistor 702.

The output source follower buffer 662 includes an NMOS transistor 734 having the drain 736 connected to power supply 716 and the source 740 connected to output 664. The gate 742 of transistor 734 is connected to the output 744 of the single stage amplifier 746 at the drain 722 of transistor 720. A current source 750 is connected between output 664 and ground 684. The multi-input single stage amplifier 746 and output buffer 662 convert the combined differential inputs to a single ended output 664 with a voltage proportional to the difference between the combination of non-inverting inputs 674 and 692 and the combination of inverting inputs 676 and 690.

Again, the LDO linear regulator with high supply rejection is not limited to use with any particular regulator architecture or amplifier, and the embodiments presented herein are merely examples.

Figure 8:
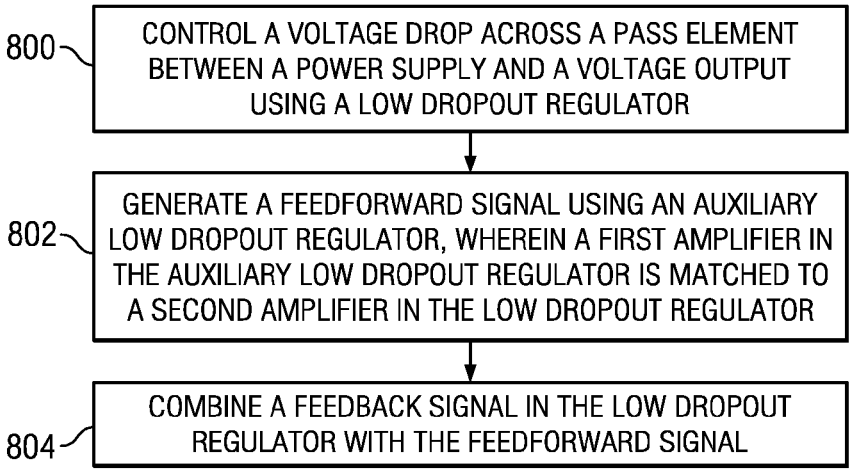
FIG. 8 is a flow diagram of a method for rejecting supply noise in an LDO regulator in accordance with some embodiments.

Some embodiments of the invention provide methods for regulating an output voltage. For example, as illustrated in the flow chart of FIG. 8, a method for regulating an output voltage includes controlling a voltage drop across a pass element between a power supply and a voltage output using a LDO regulator (block 800), and generating a feedforward signal using an auxiliary LDO regulator. (Block 802) The amplifier in the auxiliary LDO regulator is matched to the amplifier in the LDO regulator, enabling the feedforward signal to cancel supply noise in the output of the LDO regulator without introducing additional PVT variation or complexity in adjusting amplifiers. The method also includes combining a feedback signal in the LDO regulator with the feedforward signal. (Block 804) The feedforward and feedback signals may be combined in a variety of suitable manners, including inverting the feedforward signal and using it as the reference voltage in the main LDO regulator as in FIG. 2, or by combining the feedforward signal with the feedback signal in an adder or other independent component as in FIG. 4, or by combining the feedforward signal with the feedback signal using multi-input amplifiers as in FIG. 5.

The embodiments of the LDO linear regulator disclosed herein, and their variations, provide high supply rejection. By matching the amplifier in an auxiliary LDO regulator with that in the main LDO regulator, a feedforward signal may be used to cancel supply noise without the risk of substantial additional PVT variation in the feedforward signal. Distortion due to process and temperature variations in the amplifiers is minimized since the amplifiers are matched and significantly cancel such distortion. In various embodiments, the feedforward signal may be easily used by the main LDO regulator without a complicated feedforward path or additional summation blocks by using multi-input amplifiers as in FIGS. 6 and 7.

While illustrative embodiments have been described in detail herein, it is to be understood that the concepts disclosed herein may be otherwise variously embodied and employed, and that the appended claims are intended to be construed to include such variations, except as limited by the prior art.

What is claimed is:

1. An apparatus for regulating an output voltage, the apparatus comprising:

a low dropout regulator comprising a pass element and an amplifier, wherein the low dropout regulator is operable to regulate the output voltage based on a feedback signal and a feedforward signal; and an auxiliary low dropout regulator comprising an auxiliary pass element and an auxiliary amplifier, wherein the auxiliary dropout regulator is operable to generate the feedforward signal, and wherein the auxiliary amplifier is substantially matched with the amplifier, wherein the amplifier comprises a multi-input amplifier, wherein the multi-input amplifier is operable to combine the feedback signal and the feedforward signal, wherein the feedback signal is connected to a first non-inverting input of the multi-input amplifier, wherein the feedforward signal is connected to a second non-inverting input of the multi-input amplifier, and wherein a DC reference voltage input is connected to an inverting input of the multi-input amplifier, wherein the DC reference voltage input is also connected to a second inverting input of the multi-input amplifier, wherein the auxiliary amplifier comprises an auxiliary multi-input amplifier, wherein the DC reference voltage input is connected to an inverting input of the auxiliary multi-input amplifier and to a non-inverting input of the auxiliary multi-input amplifier, and wherein the feedforward signal is connected to a second non-inverting input of the auxiliary multi-input amplifier.

2. The apparatus of claim 1, further comprising an inverter connected to the feedforward signal.

3. The apparatus of claim 1, wherein the inverter comprises a unity gain for alternating currents.

4. The apparatus of claim 1, further comprising a DC reference voltage input connected to the amplifier and to the auxiliary amplifier, wherein the low dropout regulator is further operable to regulate the output voltage at a level established by the DC reference voltage input.

5. The apparatus of claim 1, further comprising an adder connected to the feedback signal and the feedforward signal, wherein an output of the adder is connected to the amplifier.

6. The apparatus of claim 1, wherein the DC reference voltage is also connected to a second inverting input of the auxiliary multi-input amplifier.

7. The apparatus of claim 1, wherein the multi-input amplifier and the auxiliary multi-input amplifier comprise differential single stage amplifiers with operational amplifier active loads and with multiple source follower inputs operable to combine multiple non-inverting inputs and multiple inverting inputs.

8. The apparatus of claim 1, wherein the multi-input amplifier and the auxiliary multi-input amplifier comprise differential single stage amplifiers with operational amplifier active loads and with multiple parallel differential input stages.

9. The apparatus of claim 1, wherein the auxiliary amplifier is smaller than the amplifier.

10. The apparatus of claim 1, further comprising:

a voltage divider connected to an output of the low dropout regulator; and an auxiliary voltage divider connected to an auxiliary output of the auxiliary low dropout regulator, wherein the voltage divider and the auxiliary voltage divider have a same divider ratio, wherein the voltage divider generates the feedback signal, and wherein the auxiliary voltage divider generates the feedforward signal.

11. The apparatus of claim 1, further comprising an output capacitor and an output current supply connected to an output of the low dropout regulator, and an auxiliary output capacitor and an auxiliary output current supply connected to an auxiliary output of the auxiliary low dropout regulator, wherein the auxiliary output current supply produces a lower current level than the output current supply.

12. A method for regulating an output voltage, the method comprising:

controlling a voltage drop across a pass element between a power supply and a voltage output using a low dropout regulator;

generating a feedforward signal using an auxiliary low dropout regulator, wherein a first amplifier in the auxiliary low dropout regulator is matched to a second amplifier in the low dropout regulator; and combining a feedback signal in the low dropout regulator with the feedforward signal, wherein the amplifier comprises a multi-input amplifier, wherein the multi-input amplifier is operable to combine the feedback signal and the feedforward signal, wherein the feedback signal is connected to a first non-inverting input of the multi-input amplifier, wherein the feedforward signal is connected to a second non-inverting input of the multi-input amplifier, and wherein a DC reference voltage input is connected to an inverting input of the multi-input amplifier, wherein the DC reference voltage input is also connected to a second inverting input of the multi-input amplifier, wherein the auxiliary amplifier comprises an auxiliary multi-input amplifier, wherein the DC reference voltage input is connected to an inverting input of the auxiliary multi-input amplifier and to a non-inverting input of the auxiliary multi-input amplifier, and wherein the feedforward signal is connected to a second non-inverting input of the auxiliary multi-input amplifier.

13. The method of claim 12, wherein combining the feedback signal in the low dropout regulator with the feedforward signal is operable to cancel supply noise from the power supply in the voltage output.

14. The method of claim 12, further comprising inverting the feedforward signal.

15. The method of claim 12, wherein a current through the low dropout regulator is greater than a second current through the auxiliary low dropout regulator.

16. An apparatus for regulating an output voltage, the apparatus comprising:

a power supply;

a reference voltage input;

a low dropout regulator connected to the power supply; and an auxiliary low dropout regulator connected to the power supply;

wherein the low dropout regulator comprises:

a pass element connected between the power supply and an output;

an amplifier connected to the pass element, the amplifier comprising a first inverting input and a second inverting input each connected to the reference voltage input;

a voltage divider connected to the output;

a feedback signal from the voltage divider connected to a first non-inverting input on the amplifier;

wherein the auxiliary low dropout regulator comprises:

an auxiliary pass element connected between the power supply and an auxiliary output;

an auxiliary amplifier connected to the auxiliary pass element, the auxiliary amplifier comprising a first inverting input, a second inverting input and a first non-inverting input each connected to the reference voltage input;

an auxiliary voltage divider connected to the auxiliary output;

a feedforward signal from the auxiliary voltage divider, wherein the feedforward signal is connected to a second non-inverting input on the auxiliary amplifier, and wherein the feedforward signal is connected to a second non-inverting input on the amplifier; and wherein the amplifier and the auxiliary amplifier are matched, and wherein the low dropout regulator and the auxiliary low dropout regulator are operable to cancel supply noise from the power supply in the output.

* * * * *